US010041674B2

(12) United States Patent
Takeuchi et al.

(10) Patent No.: US 10,041,674 B2
(45) Date of Patent: Aug. 7, 2018

(54) CERAMIC HEATER AND GLOW PLUG

(71) Applicant: NGK Spark Plug Co., LTD., Nagoya (JP)

(72) Inventors: Hiroki Takeuchi, Niwa-gun (JP); Yoshihito Ikai, Tsushima (JP)

(73) Assignee: NGK Spark Plug Co., LTD., Nagoya (JP)

( * ) Notice: Subject to any disclaimer, the term of this patent is extended or adjusted under 35 U.S.C. 154(b) by 0 days.

(21) Appl. No.: 15/252,467

(22) Filed: Aug. 31, 2016

(65) Prior Publication Data

US 2017/0074513 A1 Mar. 16, 2017

(30) Foreign Application Priority Data

Sep. 10, 2015 (JP) ..... 2015-178312

(51) Int. Cl.
*F23Q 7/00* (2006.01)
*H05B 3/48* (2006.01)

(52) U.S. Cl.
CPC ..... *F23Q 7/001* (2013.01); *H05B 3/48* (2013.01); *H05B 2203/027* (2013.01)

(58) Field of Classification Search
CPC ..... F02P 19/02; F02P 19/026; F02P 19/028; F23Q 7/00; F23Q 7/001; F23Q 7/605; H05B 3/48

(Continued)

(56) References Cited

U.S. PATENT DOCUMENTS 6,152,095 A * 11/2000 Ripma ..... H01T 13/08 123/142.5 E
2006/0011602 A1 1/2006 Konishi et al.
(Continued)

FOREIGN PATENT DOCUMENTS

EP 1612486 A 1/2006
EP 1998596 A 12/2008
(Continued)

OTHER PUBLICATIONS

Extended European Search Report dated Feb. 1, 2017 for the corresponding European Patent Application No. 16187878.0.
(Continued)

*Primary Examiner* — John Kwon
*Assistant Examiner* — Johnny H Hoang
(74) *Attorney, Agent, or Firm* — Leason Ellis LLP

(57) ABSTRACT

A ceramic heater includes a substrate containing a ceramic, and a resistor containing another ceramic and embedded in the substrate. The resistor includes two lead portions, a joint portion connecting the two lead portions, and an electrode portion formed integrally with at least one lead portion and extending in a direction crossing an axial line of the one lead portion. The electrode portion has a base end portion connected to the one lead portion, a distal end portion exposed at an outer surface of the substrate, and a connection portion disposed between the base end portion and the distal end portion and connecting the base end portion and the distal end portion together. A cross section of either the base end portion, the distal end portion, and the connection portion has an imaginary plane perpendicular to an extension direction of the electrode portion and has a streamline shape.

10 Claims, 9 Drawing Sheets

(58) Field of Classification Search
USPC .. 123/145 A, 143 R, 146.5 R, 169 R, 169 E; 219/270
See application file for complete search history.

(56) References Cited

U.S. PATENT DOCUMENTS

| | | | | |
|---|---|---|---|---|
| 2009/0194519 | A1* | 8/2009 | Funaki | F23Q 7/001 219/270 |
| 2009/0320782 | A1 | 12/2009 | Hiura | |
| 2010/0213188 | A1 | 8/2010 | Nishihara et al. | |
| 2011/0068091 | A1* | 3/2011 | Hiura | F23Q 7/001 219/270 |
| 2011/0114622 | A1* | 5/2011 | Sekiguchi | F23Q 7/001 219/270 |
| 2013/0160730 | A1* | 6/2013 | Kan | F23Q 7/001 123/145 A |
| 2013/0256298 | A1 | 10/2013 | Taimura | |
| 2014/0196680 | A1* | 7/2014 | Torazawa | H05B 3/48 123/145 A |
| 2014/0352640 | A1* | 12/2014 | Okinaka | F02P 19/028 123/145 A |
| 2014/0373800 | A1* | 12/2014 | Hirata | F23Q 7/001 123/145 A |
| 2015/0014302 | A1* | 1/2015 | Ikai | H05B 3/48 219/544 |
| 2015/0059679 | A1* | 3/2015 | Ohtani | F02P 19/028 123/179.6 |
| 2015/0334777 | A1* | 11/2015 | Sassa | G01L 9/0051 219/201 |

FOREIGN PATENT DOCUMENTS

| | | | |
|---|---|---|---|
| EP | 2247156 | A | 11/2010 |
| JP | 57-169318 | A | 10/1982 |
| JP | 03-277859 | A | 12/1991 |
| JP | 2007-240080 | A | 9/2007 |
| KR | 10-2009-0111805 | A | 10/2009 |
| WO | WO-2012/042941 | A | 4/2012 |

OTHER PUBLICATIONS

Office Action dated Dec. 26, 2017 for the corresponding Japanese Patent Application No. 2015-178312.

Office Action dated Mar. 14, 2018 for the corresponding Korean Patent Application No. 10-2016-0106823.

* cited by examiner

CERAMIC HEATER AND GLOW PLUG

This application claims the benefit of Japanese Patent Application No. 2015-178312, filed Sep. 10, 2015, which is incorporated herein by reference in its entity.

FIELD OF THE INVENTION

The present invention relates to a ceramic heater and to a glow plug provided with the ceramic heater.

BACKGROUND OF THE INVENTION

A conventional glow plug used for ignition assistance for internal combustion engines includes a ceramic heater in which a resistor formed of a conductive ceramic is disposed inside a substrate formed of an insulating ceramic. The resistor includes two rod-shaped lead portions, an approximately U-shaped joint portion that joins one end of one of the lead portions to one end of the other lead portion, and electrode portions disposed so as to protrude from the lead portions toward the outer circumferential surface of the substrate. The resistor generates heat when current is supplied to the resistor through the electrode portions. The resistor and substrate used for the ceramic heater are produced from materials each containing a ceramic and a binder (such as a resin). For example, as described in Japanese Patent Application Laid-Open (kokai) No. 2007-240080, a green intermediate molded product that later becomes the resistor in a subsequent step is formed by injection molding of a material powder containing a ceramic and a binder, and the intermediate molded product is subjected to debindering and firing, whereby the resistor is produced.

Problems to be Solved by the Invention

When a green resistor is placed in a die and then a material such as a ceramic is injected into to the die to form a green substrate such that it surrounds the green resistor, a space not filled with the material may remain near the electrode portions of the lead portions. Such a space becomes a cavity in a completed ceramic heater obtained through the subsequent debindering and firing steps. The presence of such a cavity causes a problem in that cracking starts from the cavity and the ceramic heater is damaged.

This problem is not specific to the case where ceramic heaters are manufactured by injection molding but is common to the cases where ceramic heaters are manufactured by other molding methods usable to form the substrate such as powder press molding in which a powdery material is compressed, sheet laminating molding in which sheet-shaped materials are laminated, and casting. Moreover, this problem is not specific to ceramic heaters used for glow plugs but is common to ceramic heaters used for ignition heaters and various sensors.

SUMMARY OF THE INVENTION

Means for Solving the Problems

The present invention has been made to solve the foregoing problem and can be embodied in the following modes.

(1) According to one mode of the present invention, a ceramic heater is provided. This ceramic heater comprises a substrate containing a ceramic, and a resistor embedded in the substrate and containing another ceramic. The resistor includes two lead portions extending parallel to each other, a joint portion that connects one end of a lead portion to one end of another lead portion, and an electrode portion that is formed integrally with at least one lead portion of the two lead portions and extends in a direction crossing an axial line of the one lead portion. The electrode portion has a base end portion connected to the one lead portion, a distal end portion exposed at an outer surface of the substrate, and a connection portion disposed between the base end portion and the distal end portion and connecting the base end portion and the distal end portion. A cross section of at least one of the base end portion, the distal end portion, and the connection portion has an imaginary plane perpendicular to an extension direction of the electrode portion, and said cross section having a streamline shape. According to the ceramic heater of this mode, the cross section of at least one of the base end portion, the distal end portion, and the connection portion taken along an imaginary plane perpendicular to an extension direction of the electrode portion has a streamline shape. Therefore, during manufacture of the ceramic heater, the molding material of the ceramic heater can be sufficiently distributed to an area in the vicinity of the electrode portion, whereby formation of a cavity in such an area can be suppressed.

(2) The ceramic heater of the above-described mode may be configured such that the cross section has an elongated shape having a longitudinal direction and a lateral direction perpendicular to the longitudinal direction, two end portions of the cross section in the longitudinal direction have curved outlines, and a curvature radius of one end portion is greater than a curvature radius of another end portion. According to the ceramic heater of this mode, during manufacture of the ceramic heater, the molding material of the ceramic heater can be moved smoothly in a direction from the one end portion toward the other end portion, whereby the molding material can be distributed to the area in the vicinity of the electrode portion.

(3) The ceramic heater of the above-described mode may be configured such that the cross section has an elongated shape having a longitudinal direction and a lateral direction perpendicular to the longitudinal direction, and a first intersection point, which is a point of intersection between a first line segment extending in the longitudinal direction at a position where the cross section has a maximum length in the longitudinal direction and a second line segment extending in the lateral direction at a position where the cross section has a maximum length in the lateral direction, differs from a second intersection point, which is a point of intersection between a third line segment extending in the longitudinal direction and passing through a center of a line segment extending in the lateral direction in the cross section and a fourth line segment extending in the lateral direction and passing through a center of a line segment extending in the longitudinal direction in the cross section. According to the ceramic heater of this mode, the first intersection point and the second intersection point differ from each other. Therefore, when the molding material is supplied from a position closer to the first intersection point (of the first intersection point and the second intersection point) during manufacture of the ceramic heater, the molding material can flow over a portion of the electrode portion where its cross section has the maximum length in the lateral direction thereof, at a position toward the upstream side with respect to the flow direction of the molding material; i.e., in a state in which the molding material has a larger flow force. Accordingly, the molding material can be sufficiently distributed to the second intersection point side (on the downstream side with respect to the flow direction of the molding material).

(4) The ceramic heater of the above-described mode may be configured such that, among a first cross section which is the cross section at the base end portion, a second cross section which is the cross section at the connection portion, and a third cross section which is the cross section at the distal end portion, the first cross section has the largest area, the second cross section has the second largest area, and the third cross section has the third largest area. According to the ceramic heater of this mode, the first cross section has the largest area, the second cross section has the second largest area, and the third cross section has the third largest area. Therefore, during manufacture of the ceramic heater, the molding material of the ceramic heater can be easily caused to reach an area in the vicinity of the distal end portion, which area is located near the outer surface of the substrate and is a hard-to-reach area for the molding material of the ceramic heater.

(5) The ceramic heater of the above-described mode may be configured such that, at the connection portion, the area of the cross section taken along the imaginary plane decreases from the base end portion toward the distal end portion along the extension direction. According to the ceramic heater of this mode, at the connection portion, the area of the cross section taken along the imaginary plane decreases from the base end portion toward the distal end portion along the extension direction. Therefore, during manufacture of the ceramic heater, the molding material of the ceramic heater can be easily caused to reach an area in the vicinity of the base end portion, which area is a hard-to-reach area for the molding material of the ceramic heater.

(6) The ceramic heater of the above-described mode may be configured such that the centroid of the first cross section which is the cross section at the base end portion deviates from the centroid of the third cross section which is the cross section at the distal end portion as viewed in the extension direction. According to the ceramic heater of this mode, the centroid of the first cross section and the centroid of the third cross section deviate from each other as viewed in the extension direction. Therefore, the side surface (surface extending in the extension direction) of the electrode portion can be made relatively gentle. Accordingly, during manufacture of the ceramic heater, the molding material can be easily caused to move along such a side surface, whereby the molding material can be sufficiently distributed to the vicinity of the electrode portion.

(7) The ceramic heater of the above-described mode may be configured such that, as viewed in the extension direction, the centroid of the third cross section is more remote from the joint portion as compared with the centroid of the first cross section. According to the ceramic heater of this mode, when the molding material is supplied from a position near the centroid of the third cross section as viewed in the extension direction during manufacture of the ceramic heater, movement of the molding material in a region of the side surface of the electrode portion, which region is located near the centroid of the first cross section as viewed in the extension direction, can be made easier, whereby the molding material can be sufficiently distributed to that region.

The present invention can be embodied in various modes other than the ceramic heater. For example, the present invention can be embodied as a glow plug, a method of producing the ceramic heater, a method of producing the glow plug, a resistor for the ceramic heater, a method of producing the resistor, a substrate for the ceramic heater, and a method of producing the substrate.

DETAILED DESCRIPTION OF THE INVENTION

A. Embodiments

A-1. Structure of Apparatus

Figure 1:
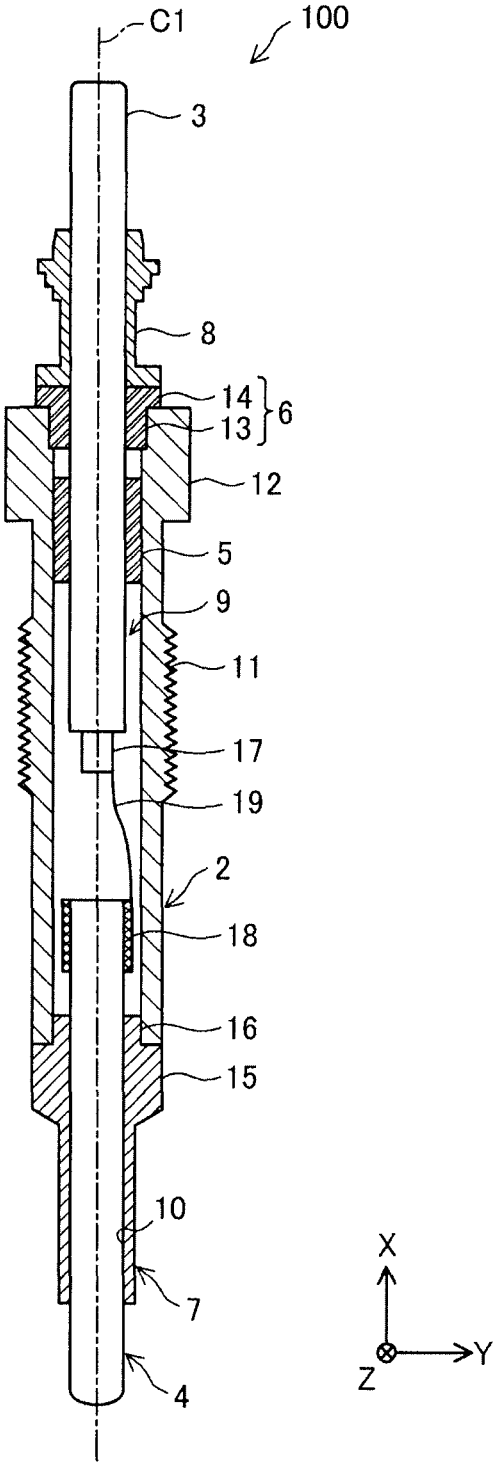
FIG. 1 is an explanatory view showing the structure of a glow plug to which a ceramic heater according to one embodiment of the present invention is applied.

FIG. 1 is an explanatory view showing the structure of a glow plug to which a ceramic heater according to one embodiment of the present invention is applied. The glow plug 100 has a rod-shaped outer shape and includes a metallic shell 2, a center shaft 3, an insulating member 5, an insulating member 6, a crimp member 8, an outer tube 7, a heater 4, an electrode ring 18, and a lead wire 19. In FIG. 1, an X axis is parallel to a center axis C1 of the glow plug 100. X, Y, and Z axes are perpendicular to one another. In the following description, the side of the glow plug 100 on which the heater 4 is disposed along the center axis C1 (a −X direction side) is referred to as a "forward end side," and the side on which the center shaft 3 is disposed along the center axis C1 (a +X direction side) is referred to as a "rear end side."

The metallic shell 2 is a metal-made member having an approximately cylindrical outer shape with an axial hole 9. On the outer circumferential surface of the metallic shell 2, a tool engagement portion 12 is formed at the rear end, and a male screw portion 11 is formed in a central portion. The tool engagement portion 12 has an outer shape (e.g., a hexagonal cross sectional shape) engageable with a prescribed tool and is engaged with the prescribed tool when the glow plug 100 is mounted to, for example, a cylinder head of an unillustrated engine. The male screw portion 11 is used to mount the glow plug 100 to the cylinder head of the unillustrated engine.

The center shaft 3 is a metal-made round bar-shaped member and is accommodated within the axial hole 9 of the metallic shell 2 such that a portion of the center shaft 3 on the rear end side protrudes from the rear end of the metallic shell 2. The center shaft 3 has at its forward end a small-diameter portion 17 smaller in diameter than the remaining portion. One end of the metal-made lead wire 19 is connected to the small-diameter portion 17, and the small-diameter portion 17 is electrically connected to the electrode ring 18 through the lead wire 19.

The insulating member 5 has a ring-like outer shape surrounding the center shaft 3 and is disposed within the axial hole 9 of the metallic shell 2. The insulating member 5 fixes the center shaft 3 such that the center axis of the metallic shell 2 and the center axis of the center shaft 3 coincide with the center axis C1 of the glow plug 100. The insulating member 5 electrically insulates the metallic shell 2 and the center shaft 3 from each other and serves as a hermetic seal therebetween. The insulating member 6 includes a tubular portion 13 and a flange portion 14. The tubular portion 13 has a ring-like outer shape, as does the insulating member 5, and is disposed at the rear end of the axial hole 9 so as to surround the center shaft 3. The flange portion 14 has a ring-like outer shape, and has a diameter larger than the outer diameter of the tubular portion 13. The flange portion 14 is disposed rearward of the tubular portion 13 so as to surround the center shaft 3, and electrically insulates the metallic shell 2 and the center shaft 3 from each other and the metallic shell 2 and the crimp member 8 from each other.

The crimp member 8 has an approximately cylindrical outer shape, is disposed so as to be in contact with the flange portion 14, and is then crimped so as to surround the center shaft 3 protruding from the rear end of the metallic shell 2. By crimping the crimp member 8 as described above, the insulating member 6 fitted between the center shaft 3 and the metallic shell 2 is fixed, so that the insulating member 6 is prevented from coming off the center shaft 3.

The outer tube 7 is a metal-made member having an approximately cylindrical outer shape with an axial hole 10 and is joined to the forward end of the metallic shell 2. A thick-walled portion 15 and an engagement portion 16 are formed at the rear end of the outer tube 7. The engagement portion 16 is disposed rearward of the thick-walled portion 15 and has an outer diameter smaller than the outer diameter of the thick-walled portion 15. The outer tube 7 is disposed such that the engagement portion 16 is fitted into the axial hole 9 of the metallic shell 2 and the thick-walled portion 15 is in contact with the forward end of the metallic shell 2. The outer tube 7 holds the heater 4 within the axial hole 10 such that the center axis of the heater 4 coincides with the center axis C1 of the glow plug 100.

The heater 4 has a cylindrical outer shape with a curved forward end surface and is fitted into the axial hole 10 of the outer tube 7. A portion of the heater 4 on the forward end side protrudes from the outer tube 7 and is exposed to an unillustrated combustion chamber. A portion of the heater 4 on the rear end side protrudes from the outer tube 7 and is accommodated within the axial hole 9 of the metallic shell 2. The structure of the heater 4 will be described in detail later. The heater 4 is a so-called ceramic heater formed of ceramic-based materials. The electrode ring 18 is a metal-made member and is fitted onto the rear end of the heater 4. One end of the lead wire 19 is connected to the electrode ring 18.

Figure 2:
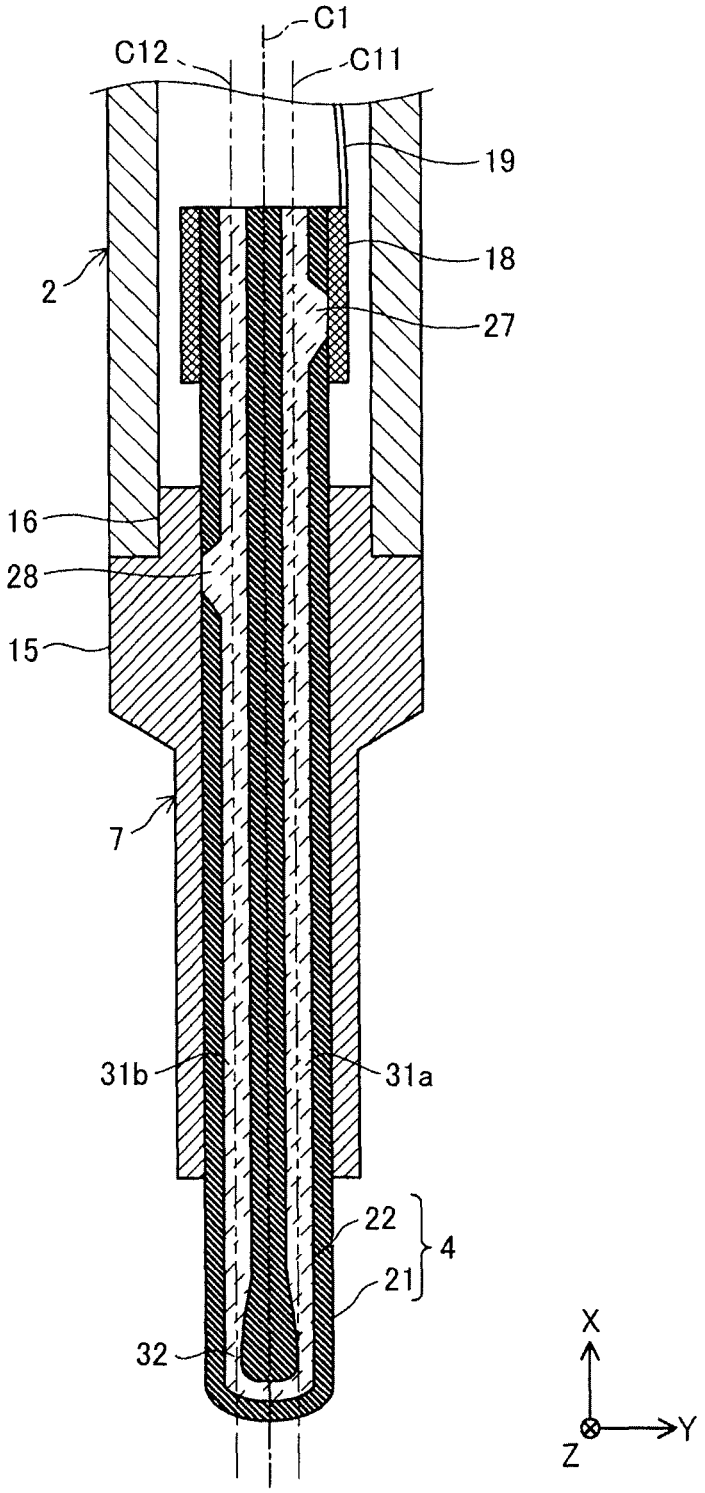
FIG. 2 is an enlarged partial cross-sectional view of the glow plug mainly showing the heater of FIG. 1.

FIG. 2 is an enlarged partial cross-sectional view of the glow plug, showing mainly the heater illustrated in FIG. 1. In FIG. 2, the same components as those in FIG. 1 are denoted by the same reference numerals, and their description will be omitted. As shown in FIG. 2, the heater 4 includes a substrate 21 and a resistor 22. The substrate 21 is formed of an insulating ceramic and has an approximately cylindrical outer shape with a curved forward end surface, and the resistor 22 is embedded in the substrate 21. The substrate 21 has two holes which are open at the surface thereof, and two electrode portions, described later, of the resistor 22 are accommodated in the two holes.

The resistor 22 is formed of a conductive ceramic. The conductive ceramic of the present embodiment is obtained, for example, by firing a conductive ceramic material containing, as a main component, silicon nitride serving as an insulating material and further containing tungsten carbide serving as an electrically conductive material. Specifically, the resistor 22 contains silicon nitride in an amount of from 56% by volume to 70% by volume inclusive and tungsten carbide in an amount of from 20% by volume to 35% by volume inclusive. The resistor 22 includes a joint portion 32 and a pair of lead portions 31*a* and 31*b*. The joint portion 32 has a U-shaped outer shape and connects the forward (the −X direction side) ends of the two lead portions 31*a* and 31*b* to each other. The joint portion 32 is a portion which generates heat when energized. To achieve high temperature by concentrating the electric current on a curved portion of the joint portion 32, the diameter of the curved portion is smaller than the diameter of the remaining portion of the joint portion 32 and the diameter of the lead portions 31*a* and 31*b*.

Each of the pair of lead portions 31*a* and 31*b* is a rod-shaped member formed of a conductive ceramic and is disposed within the substrate 21. The pair of lead portions 31*a* and 31*b* are disposed such that their longitudinal directions are parallel to each other and their center axes (axial lines) C11 and C12 are parallel to the center axis C1 of the glow plug 100. The pair of lead portions 31*a* and 31*b* are disposed such that the three center axes C1, C11, and C12 are positioned in a single imaginary plane. An electrode portion 27 is disposed on the lead portion 31*a* to be located at a position close to the rear end thereof. The electrode portion 27 is formed integrally with the lead portion 31*a*. The electrode portion 27 has one end connected to the lead portion 31*a* and extends such that its other end is located on the radially outer side. As shown in FIG. 2, this extension direction is parallel to the Y axis and perpendicular to the center axis C11. An end portion of the electrode portion 27 on the side opposite the side where the electrode portion 27 continues to the lead portion 31*a* is exposed at the outer surface of the substrate 21 and is in contact with the inner circumferential surface of the electrode ring 18. The electrode ring 18 is electrically connected to the lead portion 31*a* in the manner described above. Also, an electrode portion 28 is disposed on the lead portion 31*b* at a position close to the rear end thereof and extends radially outward. An end portion of the electrode portion 28 on the side opposite the side where the electrode portion 28 continues to the lead portion 31*b* is exposed at the outer surface of the substrate 21 and is in contact with the inner circumferential surface of the outer tube 7. The outer tube 7 is electrically connected to the lead portion 31*b* in the manner described above. Each of the pair of lead portions 31*a* and 31*b* is connected to the joint portion 32 to introduce electric current to the joint portion 32. Therefore, the center shaft 3 electrically connected to the electrode ring 18 through the lead wire 19 and the metallic shell 2 engaged with and electrically connected to the outer tube 7 serve as electrodes (positive and negative electrodes) used to supply electricity to the joint portion 32 in the glow plug 100.

Figure 3A:
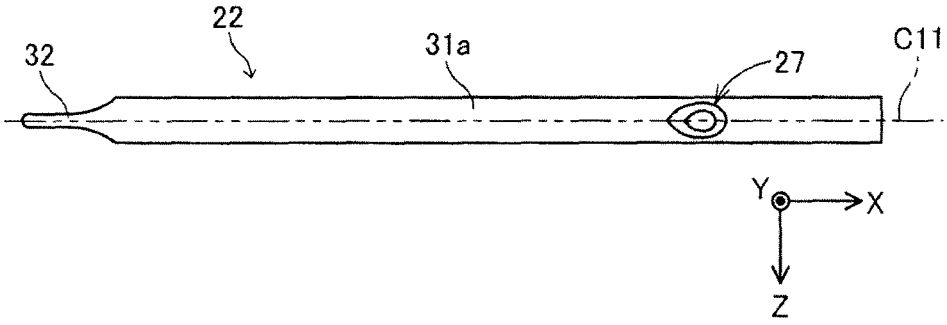
FIGS. 3(*a*) to 3(*c*) are explanatory views showing the specific structure of an electrode portion 27.
Figure 3B:
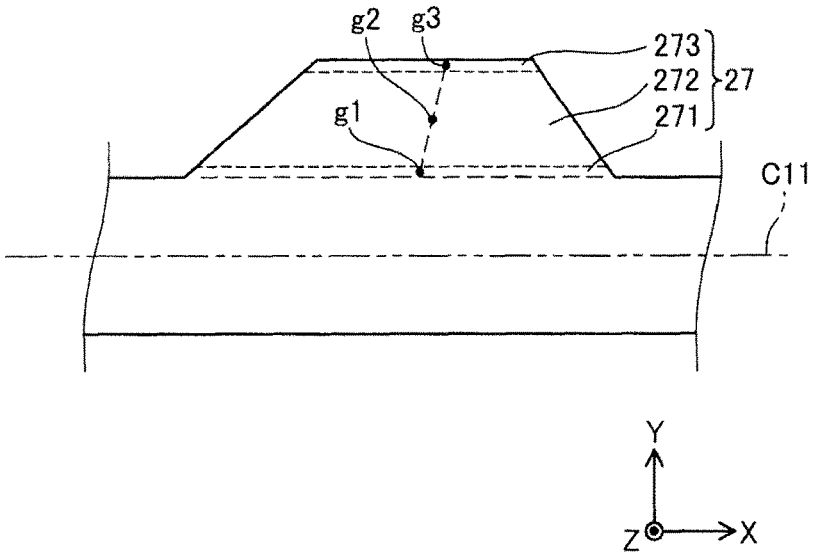
Figure 3C:
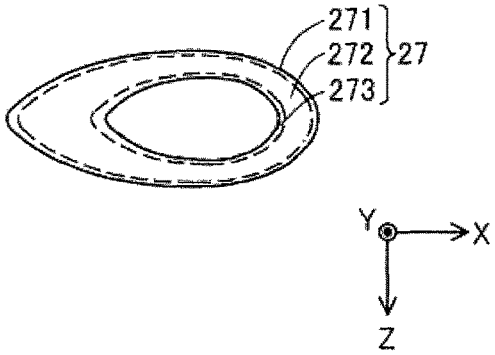

FIGS. 3(*a*) to 3(*c*) are explanatory views showing the specific structure of the electrode portion 32. FIG. 3(*a*) is a side view of the resistor 22 as viewed in a −Y direction. FIG. 3(*b*) is an enlarged partial cross-sectional view showing, on an enlarged scale, the electrode portion 27 and the vicinity thereof in a cross section of the lead portion 31*a* taken along an imaginary plane passing through the three center axes C1, C11, and C12. FIG. 3(*c*) is an enlarged partial cross-sectional view showing, on an enlarged scale, the electrode portion 27 shown in FIG. 3(*a*).

As shown in FIGS. 3(*a*) to 3(*c*), the electrode portion 27 has a columnar external shape and a streamline cross section taken along an imaginary plane perpendicular to the extension direction. As shown in FIG. 3(*b*), the electrode portion 27 is composed of three portions located adjacent to one another along the extension direction (the Y axis direction). Specifically, the electrode portion 27 has a base end portion 271, a distal end portion 273, and a connection portion 272. The base end portion 271 is a portion of the electrode portion 27 which deviates from the center of the electrode portion 27 by the greatest amount in the −Y direction and is connected to the lead portion 31*a* (in other words, continues to the lead portion 31*a*). The distal end portion 273 is a portion of the electrode portion 27 which deviates from the center of the electrode portion 27 by the greatest amount in the +Y direction and is exposed at the outer surface of the substrate 21. The connection portion 272 is disposed between the base end portion 271 and the distal end portion 273 and connects the base end portion 271 and the distal end portion 273. In the present embodiment, the base end portion 271 refers to the radially innermost portion among 10 portions of the electrode portion 27 obtained by equally dividing the electrode portion 27 into the 10 portions in the extension direction. Also, the distal end portion 273 refers to the radially outermost portion among the 10 portions of the electrode portion 27. The connection portion 272 refers to eight portions among the 10 portions of the electrode portion 27, which remain after exclusion of the radially outermost portion and the radially innermost portion from the 10 portions of the electrode portion 27. Notably, the base end portion 271, the distal end portion 273, and the connection portion 272 may be determined as follows. For example, in the case where the electrode portion 27 is equally divided into an arbitrary number (other than 10) of portions in the extension direction, the radially innermost portion is regarded as the base end portion 271, the radially outermost portion is regarded as the distal end portion 273, and the remaining portions are regarded as the connection portion 272.

In the present embodiment, the cross section of the electrode portion 27 taken along the imaginary plane perpendicular to the extension direction has a streamline shape at each of the base end portion 271, the connection portion 272, and the distal end portion 273 and has a streamline shape at any position of each portion along the extension direction.

Also, in the present embodiment, the area of the cross section of the electrode portion 27 taken along the imaginary plane perpendicular to the extension direction is the largest at a portion (connection portion) continuing to the lead portion 31*a* and decreases toward the outer surface of the substrate 21 along the extension direction of the electrode portion 27. Accordingly, among the cross-sectional area of the base end portion 271, the cross-sectional area of the connection portion 272, and the cross-sectional area of the distal end portion 273, the cross-sectional area of the base end portion 271 is the largest, the cross-sectional area of the connection portion 272 is the second largest, and the cross-sectional area of the distal end portion 273 is the third largest. The above-mentioned "cross-sectional area of the base end portion 271" means the area of a cross section of the base end portion 271 (hereinafter also referred to as the "first cross section") taken along an imaginary plane which passes through the midpoint of the base end portion 271 in the extension direction, is parallel to the lead portion 31*a* (the center axis C11), and is perpendicular to the extension direction. Similarly, the above-mentioned "cross-sectional area of the connection portion 272" means the area of a cross section of the connection portion 272 (hereinafter also referred to as the "second cross section") taken along an imaginary plane which passes through the midpoint of the connection portion 272 in the extension direction, is parallel to the lead portion 31*a* (the center axis C11), and is perpendicular to the extension direction. Similarly, the above-mentioned "cross-sectional area of the distal end portion 273" means the area of a cross section of the distal end portion 273 (hereinafter also referred to as the "third cross section") taken along an imaginary plane which passes through the midpoint of the distal end portion 273 in the extension direction, is parallel to the lead portion 31*a* (the center axis C11), and is perpendicular to the extension direction.

Also, in the present embodiment, as shown in FIG. 3(*b*), the centroid g1 of the base end portion 271, the centroid g2 of the connection portion 272, and the centroid g3 of the distal end portion 273 are located on a straight line and deviate from one another as viewed in the extension direction. More specifically, the centroid g1 deviates in the −X direction from the centroid g2 as viewed in the extension direction. In other words, as viewed in the extension direction, the centroid g2 is more remote from the joint portion 32 as compared with the centroid g1. The centroid g2 deviates in the −X direction from the centroid g3 as viewed in the extension direction. In other words, as viewed in the extension direction, the centroid g3 is more remote from the joint portion 32 as compared with the centroid g2. Also, the centroid g1 deviates in the −X direction from the centroid g3 as viewed in the extension direction. In other words, as viewed in the extension direction, the centroid g3 is more remote from the joint portion 32 as compared with the centroid g1. Due to such a configuration, as shown in FIG. 3(*b*), the side surface (sloping surface) of the electrode portion 27 on the −X direction side slopes more gently as compared with the side surface (sloping surface) of the electrode portion 27 on the +X direction side. Notably, the above-mentioned "centroid g1 of the base end portion 271" means the centroid in the above-described first cross section. Similarly, the above-mentioned "centroid g2 of the connection portion 272" means the centroid in the above-described second cross section, and the above-mentioned "centroid g3 of the distal end portion 273" means the centroid in the above-described third cross section.

Figure 4:
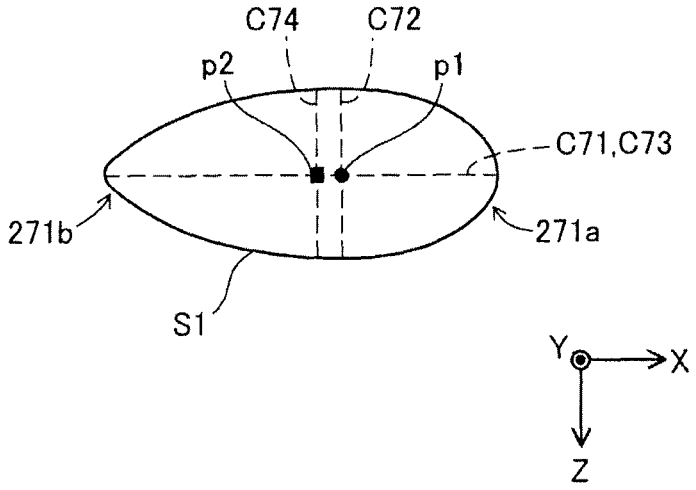
FIG. 4 is an explanatory view showing a cross section of a base end portion 271 taken along an imaginary plane perpendicular to an extension direction.

FIG. 4 is an explanatory view showing a cross section of the base end portion 271 taken along an imaginary plane perpendicular to an extension direction. The shape of this cross section S1 is an elongated shape having a longitudinal direction parallel to the X axis and a lateral direction perpendicular to the longitudinal direction. Also, the cross section S1 can be said to have an oval shape. Each of end portions 271*a* and 271*b* of the cross section S1 located on the opposite sides in the longitudinal direction has a curved outline, and the curvature radius of one end portion 271*a* is greater than that of the other end portion 271*b*. FIG. 4 shows the point of intersection p1 between a line segment (hereinafter referred to as the "first line segment") C71 extending in the longitudinal direction at a position where the length of the cross section S1 in the longitudinal direction becomes the maximum and a line segment (hereinafter referred to as the "second line segment") S72 extending in the lateral direction at a position where the length of the cross section S1 in the lateral direction becomes the maximum. Notably, in the present embodiment, the first line segment C71 coincides with a line segment (hereinafter referred to as the "third line segment") C73 which extends in the longitudinal direction and passes through the center of a lateral line segment (a lateral line segment at an arbitrary position in the longitudinal direction) in the cross section S1. Also, FIG. 4 shows the point of intersection p2 between the above-mentioned third line segment C73 and a line segment (hereinafter referred to as the "fourth line segment" C74) which extends in the lateral direction and passes through the center of a longitudinal line segment (a longitudinal line segment at an arbitrary position in the lateral direction) in the cross section S1. In the present embodiment, the above-mentioned two intersection points p1 and p2 differ from each other. FIG. 4 shows the cross section S1 of the base end portion 271 at an arbitrary position along the extension direction. The shape of a cross section of the connection portion 272 at an arbitrary position along the extension direction and the shape of a cross section of the distal end portion 273 at an arbitrary position along the extension direction are approximately similar to the shape of the cross section S1 shown in FIG. 4. Notably, the point of intersection p1 corresponds to a subgeneric concept of a first point of intersection. The point of intersection p2 corresponds to a subgeneric concept of a second point of intersection.

As described above, in the heater 4 of the present embodiment, the cross section of the electrode portion 27 taken along the imaginary plane perpendicular to the extension direction of the electrode portion 27 has a streamline shape. Therefore, when the material of the substrate 21 is injected for injection molding during the manufacture of the heater to be described later, the flow of the material in the vicinity of the electrode portion 27 (more precisely, the vicinity of a portion corresponding to the electrode portion 27 before firing) can be made smooth, whereby the material can be completely supplied to the vicinity of the electrode portion 27. Notably, as shown in FIG. 2, the electrode portion 28 has a structure which is plane symmetry with the structure of the electrode portion 27 with respect to the X-Z plane containing the center axis C1, and its specific structure is the same as that of the electrode portion 27. Therefore, the flow of the material in the vicinity of the electrode portion 28 (more precisely, the vicinity of a portion corresponding to the electrode portion 28 before firing) can be made smooth, whereby the material can be completely supplied to the vicinity of the electrode portion 28.

A-2. Production of Glow Plug

Figure 5:
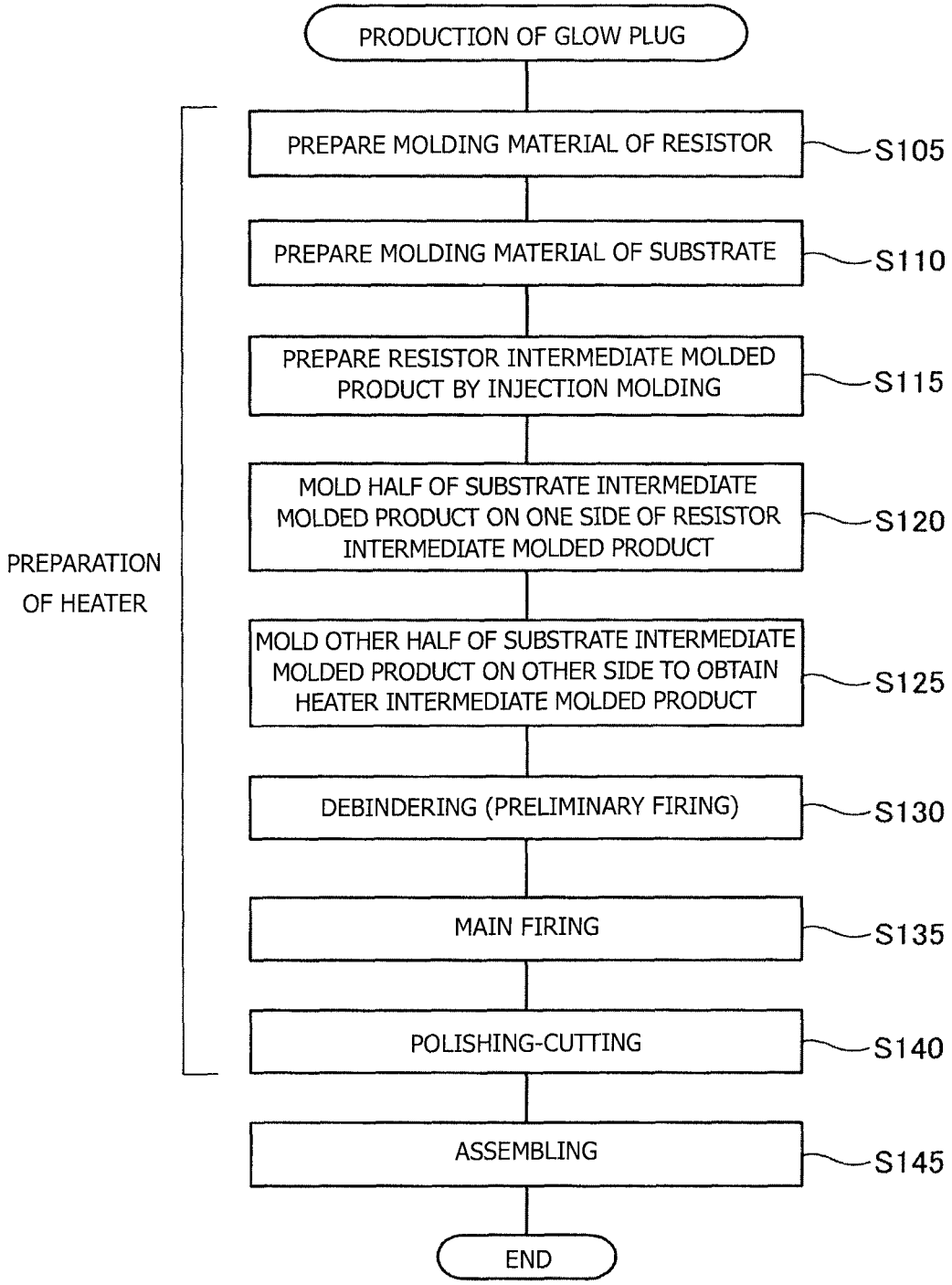
FIG. 5 is a flowchart showing a procedure for producing the glow plug 100.

FIG. 5 is a flowchart showing a procedure for producing the glow plug 100. First, a molding material of the resistor 22 is prepared (step S105), and then a molding material of the substrate 21 is prepared (step S110). In the present embodiment, the molding material of the resistor 22 is a powdery material containing an insulating ceramic and tungsten carbide as main components and can be prepared, for example, by mixing and pulverizing a raw insulating ceramic material and a raw ceramic material such as tungsten carbide, kneading the mixture, a binder, etc. using a kneader, and granulating the resultant mixture to form pellets. In the present embodiment, silicon nitride is used as the raw insulating ceramic material, but SIALON, for example, may be used instead of or in addition to the silicon nitride. In the present embodiment, no particular limitation is imposed on the binder. For example, one selected from binders such as polypropylene, plasticizers, waxes, dispersants, etc. or mixtures of two or more thereof may be used. In the present embodiment, the molding material of the substrate 21 is a powdery material containing an insulating ceramic as a main component and can be prepared, for example, by pulverizing a raw insulating ceramic material, kneading the pulverized product, a binder, etc. using a kneader, and granulating the resultant mixture to form pellets. The type of the raw ceramic material and the type of the binder may be the same as those for the molding material of the resistor 22.

An intermediate molded product of the resistor 22 is produced by injection molding using the molding material obtained in step S105 (step S115). In the present embodiment, "the intermediate molded product of the resistor 22" means a member that later becomes the resistor 22 through heating steps such as debindering and firing described later.

A half of an intermediate molded product of the substrate 21 is formed on one side of the intermediate molded product of the resistor 22 obtained in step S115 (step S120). The other half of the intermediate molded product of the substrate 21 is formed on the other side of the intermediate molded product of the resistor 22 to thereby obtain an intermediate molded product of the heater 4 (step S125). In each of steps S120 and S125, the molding material obtained in step S110 is injection-molded.

Figure 6:
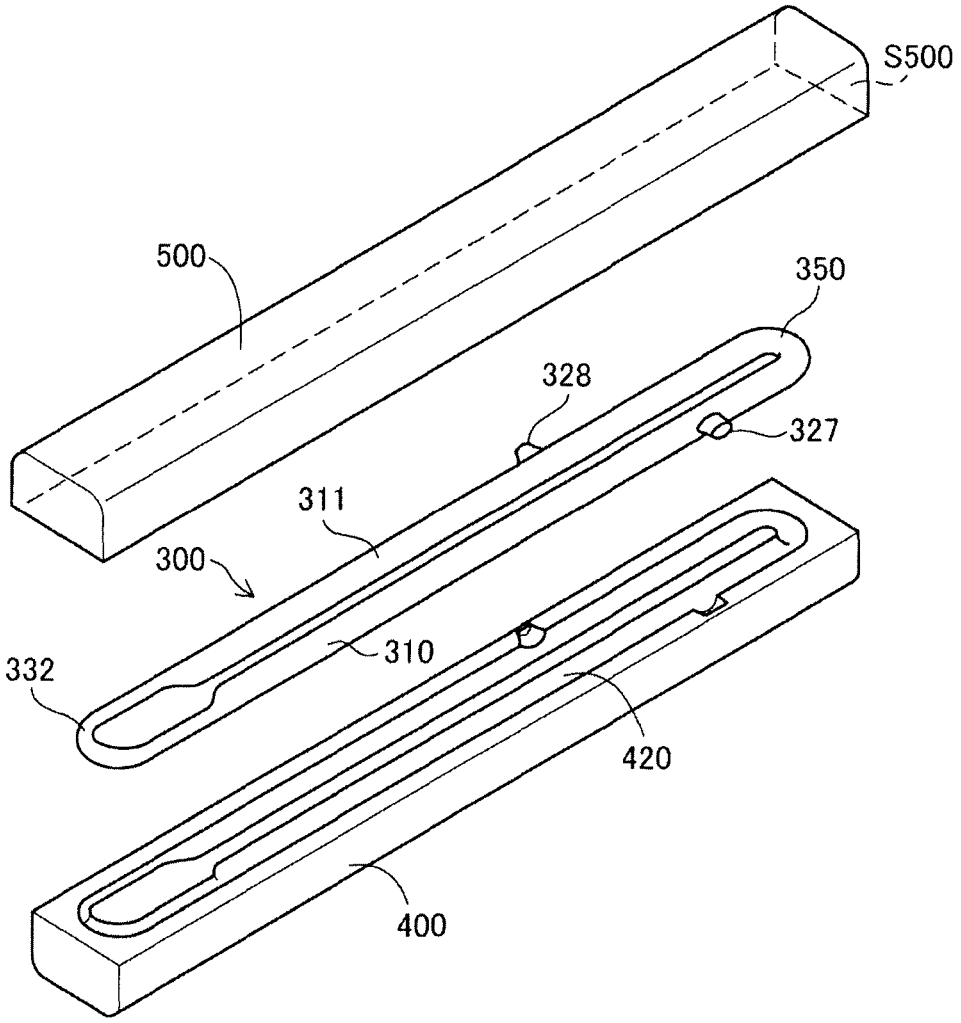
FIG. 6 is an explanatory view schematically showing the detail of the processing in step S120.
Figure 7:
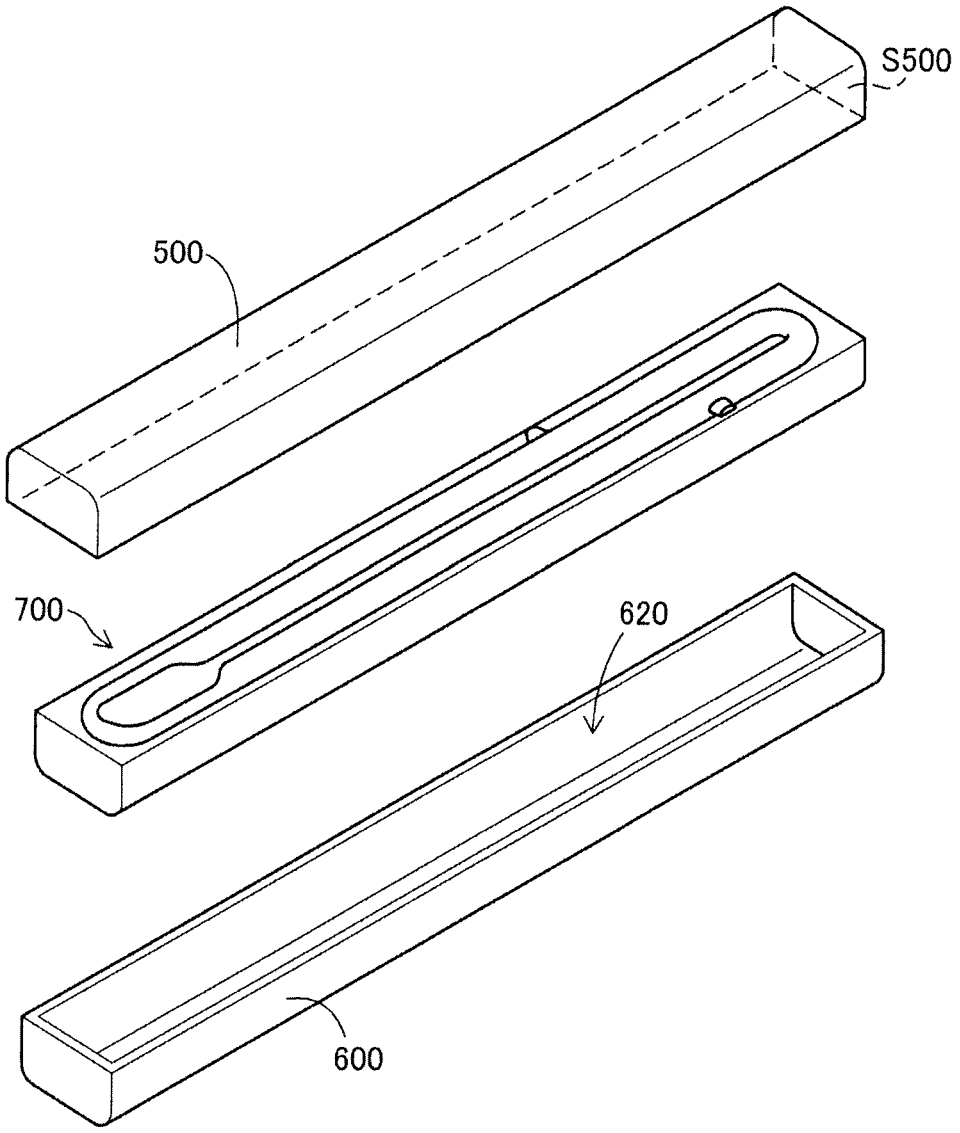
FIG. 7 is an explanatory view schematically showing the detail of the processing in step S125.

FIG. 6 is an explanatory view schematically showing the detail of the processing in step S120. FIG. 7 is an explanatory view schematically showing the detail of the processing in step S125. In step S120, first, the intermediate molded product 300 of the resistor 22 is placed in a cavity 420 formed in a lower die 400, and an upper die 500 is placed so as to cover the upper half of the intermediate molded product 300. The intermediate molded product 300 of the resistor 22 has an outer shape approximately geometrically similar to that of the resistor 22. Specifically, the intermediate molded product 300 includes a lead-forming portion 310 corresponding to the lead portion 31*a*, a lead-forming portion 311 corresponding to the lead portion 31*b*, a joint portion-forming portion 332 corresponding to the joint portion 32, and two electrode-forming portions 327 and 328 corresponding to the two electrode portions 27 and 28. The intermediate molded product 300 further includes a rear-end joint portion 350. In the intermediate molded product 300, the rear-end joint portion 350 connects together ends of the two lead-forming portions 310 and 311 on the side opposite the joint portion-forming portion 332. The rear-end joint portion 350 is provided in order to prevent a change in the relative positions of the two lead-forming portions 310 and 311 to thereby facilitate the handling of the intermediate molded product 300.

The cavity 420 formed in the lower die 400 has a shape which allows the lower half of the intermediate molded product 300 of the resistor 22 to be fitted into the cavity 420. The upper die 500 has a hollow approximately rectangular cuboidal shape having an opening on its mating surface which mates with the lower die 400. An injection hole for filling the space inside the upper die 500 with a molding material is provided on one longitudinal end surface S500 of the upper die 500. After the intermediate molded product 300, the lower die 400, and the upper die 500 are disposed as described above, the molding material obtained in step S110 is injected into the upper die 500 to form a half of the intermediate molded product of the substrate 21 on one side (the upper side in FIG. 6) of the intermediate molded product of the resistor 22. An intermediate molded product 700 shown in FIG. 7 is thereby obtained.

In step S125, the intermediate molded product 700 obtained in step S120 is turned upside down to orient it as shown in FIG. 7 and is placed in a cavity 620 formed in a different lower die 600. Next, the upper die 500 is disposed so as to cover the upper half of the intermediate molded product 700. The cavity 620 formed in the lower die 600 has a shape which allows a portion of the intermediate molded product 700 corresponding to the intermediate molded product of the substrate to be closely fitted into the cavity 620. This upper die 500 is the same as the upper die 500 shown in FIG. 6. After the intermediate molded product 700, the lower die 600, and the upper die 500 are disposed as described above, the molding material obtained in step S110 is injected into the upper die 500 to form the other half of the intermediate molded product of the substrate 21 on the upper side of the intermediate molded product 700. The intermediate molded product of the heater 4 is obtained in the manner described above. In the present embodiment, the "intermediate molded product of the "heater 4" means a member that later becomes the heater 4 through various steps such as debindering, firing, polishing, and cutting, which will be described later.

Figure 8:
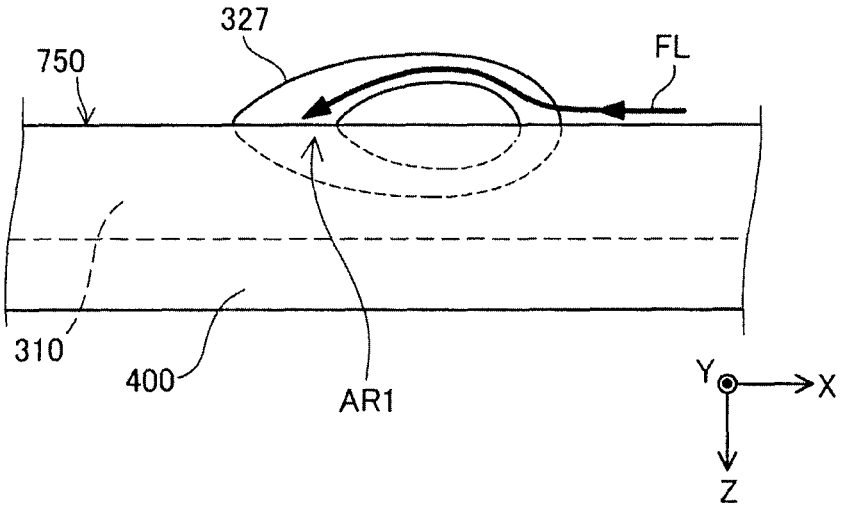
FIG. 8 is an explanatory view schematically showing the flow of a molding material in the vicinity of an electrode-forming portion 327.

FIG. 8 is an explanatory view schematically showing the flow of the molding material in the vicinity of the electrode-forming portion 327. In FIG. 8, the intermediate molded product 700 in step S125 is viewed in the −Y direction. In FIG. 8, the upper die 500 and the lower die 600 are omitted. In the present embodiment, a boundary surface 750 between the upper die 500 and the intermediate molded product 700 coincides with the imaginary plane passing through the three center axes C1, C11, and C12.

As described above, in step S125, the molding material is injected into the upper die 500 from the end surface S500 of the upper die 500. Therefore, the molding material flows within the upper die 500 in a direction from the end surface S500 toward the surface on the opposite side. As shown by a thick solid arrow FL in FIG. 8, in the vicinity of the electrode-forming portion 327, the material flowing from the end surface S500 approximately in the −X direction reaches the electrode-forming portion 327. Since the cross section of the electrode forming portion 327 taken along the imaginary plane perpendicular to the extension direction of the electrode forming portion 327 (the +Y direction) has a streamline shape, the molding material reaching the electrode forming portion 327 moves along the side surface (outer surface extending in the extension direction) of the electrode forming portion 327 and reaches an area AR on the −X direction side of the electrode forming portion 327. Therefore, the molding material is charged into the area AR1, whereby formation of a cavity is restrained.

Notably, in the above-described steps S120 and 125, instead of injection molding, powder press molding which compresses a powdery molding material may be used to form the intermediate molded product of the heater 4. Also, instead of injection molding and powder press molding, there may be used sheet laminating molding in which a molding material is formed into sheets, and the sheets of the molding material are laminated.

After the intermediate molded product of the heater 4 is obtained in step S125 as shown in FIG. 5, debindering of the intermediate molded product of the heater 4 is performed (step S130). The intermediate molded product of the heater 4 contains the binder, and the binder is removed by heating (preliminary firing). For example, the intermediate molded product of the heater 4 may be heated at 800° C. in a nitrogen atmosphere for 60 minutes. After step S130, main firing is performed (step S135). In the main firing, heating is performed at higher temperature than the temperature of the preliminary firing in step S130. The heating may be performed at, for example, 1,750° C. In this case, so-called hot-press firing in which the intermediate molded product of the heater 4 is pressed may be performed.

Then polishing and cutting are performed (step S140). In this step, the outer circumference of the fired product obtained in step S135 is polished, and the forward end portion of the fired product is shaped into a curved surface. As a result of the polishing, the electrode portions 27 and 28 are exposed at the surface of the substrate 21. As a result of the cutting, the rear end portion of the fired product obtained in step S135, i.e., a portion corresponding to the rear-end joint portion 350, is removed. The heater 4 is completed through steps S105 to S140 described above. Then, components of the glow plug 100 shown in FIG. 1 are assembled (step S145), and the glow plug 100 is thereby completed. Notably, known methods can be employed so as to manufacture the components such as the metallic shell 2. The above-described steps S105 to S140 correspond to the method of manufacturing the heater 4.

In the glow plug 100 of the embodiment described above, the cross section of the electrode portion 27, 28 taken along the imaginary plane perpendicular to the extension direction of the electrode portion 27, 28 has a streamline shape at any position along the extension direction of the electrode portion 27, 28. Therefore, when the molding material of the substrate 21 is injected in the steps S120 and S125 of the heater manufacturing process, the molding material can be sufficiently distributed to an area near the electrode forming portion 327, 328; in particular, the area AR1 which is an area on the downstream side of the electrode forming portion 327, 328 with respect to the flow direction of the molding material. Therefore, it is possible to suppress formation of a cavity in the area AR1 in the completed heater 4 obtained through subsequent steps such as debindering and firing. Accordingly, it is possible to suppress a drop in the strength of the completed heater 4, which drop occurs as a result of formation of such a cavity.

Also, at any position along the extension direction of the electrode portion 27, 28, the cross section of the electrode portion 27, 28 taken along the imaginary plane perpendicular to the extension direction has longitudinal opposite end portions each having a curved outline, and the curvature radius of one of the end portions is greater than that of the other end portion. Therefore, the molding material can be moved smoothly in the direction from the one end to the other end, whereby the molding material can be sufficiently charged to the area AR1.

Also, at any position along the extension direction of the electrode portion 27, 28, the cross section of the electrode portion 27, 28 taken along the imaginary plane perpendicular to the extension direction has a shape in which the point of intersection p1 between the first line segment and the second line segment and the point of intersection p2 between the third line segment and the fourth line segment differ from each other; i.e., the intersection points p1 and p2 do not coincide with each other. In this case, when the molding material is supplied from a position closer to the intersection point p1, the molding material can flow over a portion of the electrode portion where its cross section has the maximum length in the lateral direction thereof, in a state in which the molding material has a larger flow force. Accordingly, the molding material can be sufficiently distributed to the area AR1, which is an area on the side of the electrode forming portion 327, 328 where the intersection point p2 is present; i.e., an area on the downstream side of the electrode forming portion 327, 328 with respect to the flow direction of the molding material.

Also, the area of the cross section of the electrode portion 27 is the largest in a region where the electrode portion 27 continues to the lead portion 31*a* and gradually decreases toward the surface of the substrate 21 along the extension direction of the electrode portion 27. Therefore, in step S125, the molding material can be easily caused to reach the hard-to-reach area in the vicinity of the base end portion 271.

B. Example

A plurality of samples of the heater 4 of the above-described embodiment were manufactured, and a strength measurement test was carried out for each sample. Also, a plurality of samples of a heater of a comparative example (Comparative Example) were manufactured, and the strength measurement test was carried out for each sample. Table 1 shows the results of the test. Samples 1 and 3 correspond to the heater 4 of the embodiment (Example). Accordingly, the cross-sectional shape (the shape of a cross section taken along an imaginary plane perpendicular to the extension direction) of the electrode portion 27, 28 in each of Samples 1 and 3 was streamline. In steps S120 and S125 of the process of preparing Sample 1, the intermediate molded product of the heater 4 was formed by powder press molding. In contrast, in steps S120 and S125 of the process of preparing Sample 3, the intermediate molded product of the heater 4 was formed by injection molding. Samples 2 and 4 correspond to the heater of Comparative Example. The cross-sectional shape of the electrode portion in each of Samples 2 and 4 was rectangular. During preparation of Sample 2, the intermediate molded product of the heater was formed by powder press molding. During preparation of Sample 4, the intermediate molded product of the heater was formed by injection molding. As each of Samples 1 to 4, 10 heaters having the same shape were prepared by the same manufacturing method.

The three-point bending strength of each of the prepared heaters was measured with a span of 12 mm. In this measurement, the surface on which the distal end portion of the electrode portion 28 was disposed was used as a tensile surface. The strength of each sample shown in Table 1 is the lowest strength among the measured strengths of the 10 heaters of the sample. In the results of the evaluation of strength in Table 1, "AA" (a good rating) is given when the strength is 1,000 MPa or more, and "XX" (a poor rating) is given when the strength is less than 1,000 MPa.

TABLE 1

| Sample No. | Molding method | Cross-sectional shape of electrode portion | Strength (Mpa) | Evaluation | |
|---|---|---|---|---|---|
| 1 | Press | Streamline | 1100 | AA | (Example) |
| 2 | molding | Rectangular | 900 | XX | (Comparative Example) |

TABLE 1-continued

| Sample No. | Molding method | Cross-sectional shape of electrode portion | Strength (Mpa) | Evaluation | |
|---|---|---|---|---|---|
| 3 | Injection | Streamline | 1200 | AA | (Example) |
| 4 | molding | Rectangular | 920 | XX | (Comparative Example) |

As shown in Table 1, since the strengths of Samples 2 and 4 of Comparative Example were 920 MPa or less, Samples 2 and 4 were evaluated to be poor (XX). The presumed reason for the relatively low strengths of Samples 2 and 4 of Comparative Example is that since in Samples 2 and 4 of Comparative Example, the cross-sectional shape of the electrode portion was rectangular, when the intermediate molded product of the heater was formed, a hard-to-reach space for the molding material was present in the vicinity of the electrode forming portion, and such a space appeared as a cavity in the completed heater.

In contrast, since the strengths of Samples 1 and 3 of Example were 1000 MPa or more, Samples 1 and 3 of Example were evaluated to be good (AA). In Samples 1 and 3 of Example, since the cross-sectional shape of the electrode portion 27, 28 is streamline, as described above, the molding material can be sufficiently charged to the area in the vicinity of the electrode forming portion when the intermediate molded product of the heater 4 is formed. Therefore, it is presumed that formation of a cavity in the vicinity of the electrode portion 27, 28 of the completed heater 4 was restrained, and therefore, Samples 1 and 3 were high in strength.

C. Modifications

C1. Modification 1

In the above-described embodiment and example, the cross-sectional shape of the electrode portion 27, 28 is oval as shown in FIG. 4. However, the present invention is not limited thereto.

Figure 9A:
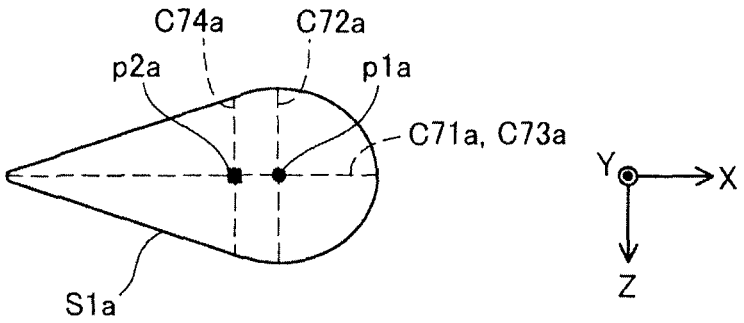
FIGS. 9(*a*) and 9(*b*) are explanatory views showing the cross-sectional shapes of electrode portions according to modification 1.
Figure 9B:
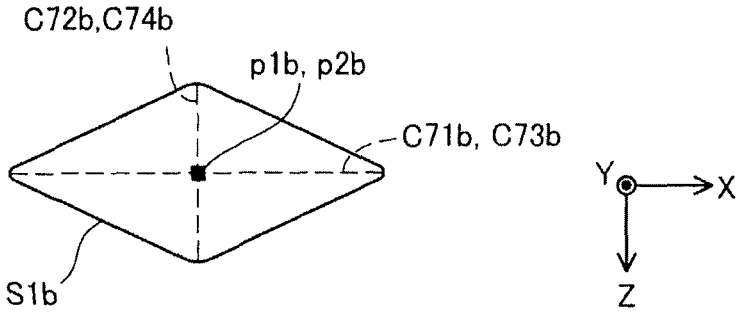

FIGS. 9(*a*) and 9(*b*) are explanatory views showing the cross-sectional shapes of electrode portions according to modification 1. FIG. 9(*a*) shows a first mode of the cross-sectional shape of the electrode portion in the modification 1, and FIG. 9(*b*) shows a second mode of the cross-sectional shape of the electrode portion in the modification 1. Like FIG. 4, each of FIGS. 9(*a*) and 9(*b*) shows the shape of a cross section of the electrode portion taken along an imaginary plane perpendicular to the extension direction of the electrode portion.

In the first mode of the modification 1 shown in FIG. 9(*a*), the shape of the cross section S1*a* of the electrode portion is a so-called teardrop shape whose longitudinal direction corresponds to the X direction. The difference between the curvature radiuses of the longitudinal opposite end portions of the cross section S1*a* is greater than the difference between the curvature radiuses of the opposite end portions 271*a* and 271*b* of the cross section S1 shown in FIG. 4. In the cross section S1*a*, the first line segment C71*a* coincides with the third line segment C73*a* as in the cross section S1 shown in FIG. 4. Also, as in the cross section S1, the point of intersection p1*a* between the first line segment C71*a* and the second line segment C72*a* and the point of intersection p2*a* between the third line segment C73*a* and the fourth line segment C74*a* differ from each other.

In the second mode of the modification 1 shown in FIG. 9(*b*), the cross section Sib of the electrode portion has a shape whose longitudinal direction coincides with the X direction and which is similar to a chamfered rhombus. In the cross section Sib, the first line segment C71*b* coincides with the third line segment C73*b* as in the cross section S1 shown in FIG. 4. Also, the second line segment C72*b* and the fourth line segment C74*b* coincide with each other. Therefore, unlike the cross section S1 shown in FIG. 4, the point of intersection p1*b* between the first line segment C71*b* and the second line segment C72*b* and the point of intersection p2*b* between the third line segment C73*b* and the fourth line segment C74*b* coincide with each other. A heater which has an electrode portion having a cross-sectional shape shown in FIG. 9(*a*) or 9(*b*) and a glow plug which includes such a heater have advantageous effects similar to those of the heater 4 and the glow plug 100 of the above-described embodiment and example.

C2. Modification 2

In the above-described embodiment and example, the shapes of cross sections of the electrode portion 27 at different positions in the extension direction of the electrode portion 27 are approximately similar to one another. However, the present invention is not limited thereto.

Figure 10:
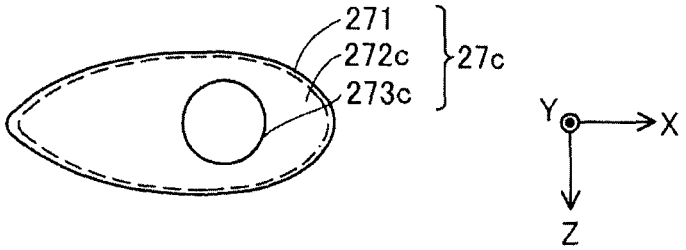
FIG. 10 is an explanatory view showing an electrode portion according to modification 2.

FIG. 10 is an explanatory view showing an electrode portion according to modification 2. Like FIG. 3(*c*), FIG. 10 shows, on an enlarged scale, an electrode portion on a side surface of a resistor as viewed in the −Y direction.

The electrode portion 27*c* according to the modification 2 differs from the electrode portion of the above-described embodiment and example in that the electrode portion 27*c* has a distal end portion 273*c* in place of the distal end portion 273 and a connection portion 272*c* instead of the connection portion 272. The unillustrated other electrode portion in the modification 2 has a structure similar to that of the electrode portion 27*c*. The structures of a heater and a glow plug according to the modification 2 are the same as the structures of the heater 4 and the glow plug 100 of the embodiment and the example, except for the structure of the above-mentioned electrode portion.

In the modification 2, the distal end portion 273*c* has a circular columnar external shape, and the shape of the cross section of the distal end portion 273*c* at any position along the extension direction (the +Y direction) is an approximately perfect circular shape. The cross-sectional shape of the connection portion 272*c* is an approximately perfect circular shape in a region where the connection portion 272*c* continues (is connected) to the distal end portion 273*c*. The cross-sectional shape of the connection portion 272*c* is a streamline shape (oval shape), as in the embodiment, in a region where the connection portion 272*c* continues (is connected) to the base end portion 271. A heater and a glow plug according to the modification 2 each of which includes an electrode having such a structure have advantageous effects similar to those of the heater 4 and the glow plug 100 of the above-described embodiment and example. Notably, in the above-described structure of the modification 2, instead of or in addition to the distal end portion 273*c*, the base end portion 271 may have a cross section of a perfect circular shape. Also, in the structure of the modification 2, instead of the perfect circular shape, any shape other than streamline may be employed. As can be understood from the above-described embodiment, example, and modifications 1 and 2, the structure in which the cross section of at least one of the base end portion, the distal end portion, and the connection portion taken along the imaginary plane perpendicular to the extension direction of the electrode portion has a streamline shape can be applied to the present invention. The "cross section of at least one of the base end portion, the distal end portion, and the connection portion taken along the imaginary plane perpendicular to the extension direction of the electrode portion" means at least one of the first cross section, the second cross section, and the third cross section in the above-described embodiment.

Also, as can be understood from the above-described structure of the modification 2, at least one of the base end portion and the distal end portion may be formed such that the area of the cross section taken along the imaginary plane perpendicular to the extension direction does not decrease gradually toward the surface of the substrate 21 along the extension direction. In the modification 2, the cross-sectional areas of the distal end portion 273*c* at different positions along the extension direction are equal to one another. Like the distal end portion 273*c*, the connection portion 272, 272*c* or the base end portion 271 may be formed such that the cross-sectional areas at different positions along the extension direction are equal to one another. Also, the connection portion 272 may be formed such that the cross-sectional area of the connection portion 272 is the largest at the center position in the extension direction of the connection portion 272, and decreases toward the base end portion 271 and toward the distal end portion 273. However, the connection portion 272, 272*c* is preferably formed such that the area of the cross section taken along the imaginary plane perpendicular to the extension direction decreases gradually toward the surface of the substrate 21 along the extension direction. In this case, in step S125, the molding material can be easily caused to flow from the base end 271 side toward the distal end portion 273, 273*c* side.

C3. Modification 3

In the above-described embodiment and example, the centroid g1 of the base end portion 271, the centroid g2 of the connection portion 272, and the centroid g3 of the distal end portion 273 deviate from one another as viewed in the extension direction. However, the present invention is not limited thereto. The electrode portion may be formed such that, of the three centroids g1, g2, and g3, two centroids g1 and g3 deviate from each other as viewed in the extension direction as in the case shown in FIG. 3(*b*), and the remaining centroid g2 coincides with one of the two centroids g1 and g3 as viewed in the extension direction. Namely, in general, the structure in which, as viewed in the extension direction, the centroid g3 is more remote from the joint portion 32 as compared with the centroid g1 may be applied to the present invention. Also, the positional relation between the two centroids g1 and g3 as viewed in the extension direction may be reversed. Specifically, the electrode portion may be formed such that, as viewed in the extension direction, the centroid g1 is more remote from the joint portion 32 as compared with the centroid g3. This configuration also provides advantageous effects similar to those of the above-described embodiment and example in the case where the injection direction of the molding material in step S125 is opposite the injection direction in the above-described embodiment and example. Namely, in general, the structure in which the centroid g1 and the centroid g3 deviate from each other as viewed in the extension direction may be applied to the present invention.

C4. Modification 4

In the above embodiments and examples, the electrically conductive material in the molding material of the resistor 22 is tungsten carbide. However, any electrically conductive material such as molybdenum silicide or tungsten silicide may be used instead of tungsten carbide.

C5. Modification 5

In the above embodiments, the heater 4 is a ceramic heater used for the glow plug 100. The heater 4 may be used for components other than the glow plug 100. Specifically, the heater 4 may be an ignition heater for a burner, a heater for heating a gas sensor, or a ceramic heater used for a DPF (diesel particulate filter).

C6. Modification 6

The present invention is not limited to the above described embodiment, example, and modifications and may be embodied in various other forms without departing from the spirit of the invention. For example, the technical features in the embodiment and modifications corresponding to the technical features in the modes described in Summary of the Invention can be appropriately replaced or combined to solve some of or all the foregoing problems or to achieve some of or all the foregoing effects. A technical feature which is not described as an essential feature in the present specification may be appropriately deleted.

DESCRIPTION OF REFERENCE NUMERALS

2: metallic shell
3: center shaft
4: heater
5: insulating member
6: insulating member
7: outer tube
8: crimp member
9: axial hole
10: axial hole
11: male screw portion
12: tool engagement portion
13: tubular portion
14: flange portion
15: thick-walled portion
16: engagement portion
17: small-diameter portion
18: electrode ring
19: lead wire
21: substrate
22: resistor
27, 27*c*, 27*d*, 28: electrode portion
31*a*, 31*b*: lead portion
32: joint portion
100: glow plug
271, 271*d*: base end portion
271*a*: end portion
271*b*: end portion
272, 272*c*, 272*d*: connection portion
273, 273*c*, 273*d*: distal end portion
300: intermediate molded product
310, 311: lead-forming portion
327, 328: electrode-forming portion
332: joint portion-forming portion
350: rear-end joint portion
400: intermediate molded product
420: cavity
500: upper die
600: lower die
620: cavity
700: intermediate molded product
750: boundary surface
AR1: area
C1, C11, C12: center axis
C71, C71*a*, C71*b*: first line segment
C72, C72*a*, C72*b*: second line segment
C73, C73*a*, C73*b*: third line segment
C74, C74*a*, C74*b*: fourth line segment
FL: material
S500: end surface
S1, S1*a*, S1*b*: cross section
g1: centroid
g2: centroid
g3: centroid
p1, p1*a*, p1*b*: point of intersection
p2, p2*a*, p2*b*: point of intersection

The invention claimed is:

1. A ceramic heater comprising:
a substrate containing a ceramic; and
a resistor embedded in the substrate and containing another ceramic, the resistor including;
two lead portions extending parallel to each other,
a joint portion that connects one end of a lead portion to one end of another lead portion, and
an electrode portion that is formed integrally with at least one lead portion of the two lead portions and extends in a direction crossing an axial line of the one lead portion, the electrode portion having a base end portion connected to the one lead portion, a distal end portion exposed at an outer surface of the substrate, and a connection portion disposed between the base end portion and the distal end portion and connecting the base end portion and the distal end portion,
wherein a cross section of at least one of the base end portion, the distal end portion,
the connection portion has an imaginary plane perpendicular to an extension direction of the electrode portion, and said cross section having a streamline shape, and
the area of the cross section taken along the imaginary plane continuously decreases from an inner surface of the base end portion toward an outer surface of the distal end portion along the extension direction.

2. The ceramic heater according to claim 1, wherein
the cross section has an elongated shape having a longitudinal direction and a lateral direction perpendicular to the longitudinal direction,
two end portions of the cross section in the longitudinal direction have curved outlines, and
a curvature radius of one end portion is greater than a curvature radius of another end portion.

3. The ceramic heater according to claim 1, wherein
the cross section has an elongated shape having a longitudinal direction and a lateral direction perpendicular to the longitudinal direction, and
a first intersection point, which is a point of intersection between a first line segment extending in the longitudinal direction at a position where the cross section has a maximum length in the longitudinal direction and a second line segment extending in the lateral direction at a position where the cross section has a maximum length in the lateral direction, differs from a second intersection point, which is a point of intersection between a third line segment extending in the longitudinal direction and passing through a center of a line segment extending in the lateral direction in the cross section and a fourth line segment extending in the lateral direction and passing through a center of a line segment extending in the longitudinal direction in the cross section.

4. The ceramic heater according to claim 1, wherein, among a first cross section which is the cross section at the base end portion, a second cross section which is the cross section at the connection portion, and a third cross section which is the cross section at the distal end portion, the first cross section has the largest area, the second cross section has the second largest area, and the third cross section has the third largest area.

5. The ceramic heater according to claim 1, wherein, at the connection portion, the area of the cross section taken along the imaginary plane decreases from the base end portion toward the distal end portion along the extension direction.

6. The ceramic heater according to claim 1, wherein the centroid of the first cross section which is the cross section at the base end portion deviates from the centroid of the third cross section which is the cross section at the distal end portion as viewed in the extension direction.

7. The ceramic heater according to claim 6, wherein, as viewed in the extension direction, the centroid of the third cross section is more remote from the joint portion as compared with the centroid of the first cross section.

8. The glow plug comprising the ceramic heater according to claim 1.

9. The ceramic heater according to claim 2, wherein a first intersection point, which is a point of intersection between a first line segment extending in the longitudinal direction at a position where the cross section has a maximum length in the longitudinal direction and a second line segment extending in the lateral direction at a position where the cross section has a maximum length in the lateral direction, differs from a second intersection point, which is a point of intersection between a third line segment extending in the longitudinal direction and passing through a center of a line segment extending in the lateral direction in the cross section and a fourth line segment extending in the lateral direction and passing through a center of a line segment extending in the longitudinal direction in the cross section.

10. The ceramic heater according to claim 1, wherein an outer diameter of the distal end portion continuously decreases from a bottom to an outer surface thereof.

* * * * *